United States Patent [19]

Dunlap

[11] 3,951,096

[45] Apr. 20, 1976

[54] MARINE DRIVE SYSTEM

[76] Inventor: Clifford E. Dunlap, 437 Lola St., Pasadena, Calif. 91107

[22] Filed: Mar. 14, 1974

[21] Appl. No.: 451,133

[52] U.S. Cl. ..... 115/34 R
[51] Int. Cl.[2] ..... B63H 1/14
[58] Field of Search ..... 115/34 R, 34 B, 17, 115/18 R, 35, 41; 156/137

[56] References Cited

UNITED STATES PATENTS

| | | | |
|---|---|---|---|
| 2,518,808 | 8/1950 | Nadolinski | 115/18 R |
| 3,088,430 | 5/1963 | Champney | 115/41 R |
| 3,204,598 | 9/1965 | Sharp | 115/34 R |
| 3,403,655 | 10/1968 | Warburton | 115/41 R |
| 3,487,803 | 1/1970 | Alexander, Jr. | 115/17 |
| 3,596,753 | 8/1971 | Knapp et al. | 156/137 |
| 3,673,023 | 6/1972 | Ross | 156/137 |

FOREIGN PATENTS OR APPLICATIONS

| | | | |
|---|---|---|---|
| 787,656 | 9/1935 | France | 115/17 |
| 948,854 | 9/1956 | Germany | 115/41 R |

*Primary Examiner*—Trygve M. Blix
*Assistant Examiner*—Sherman D. Basinger
*Attorney, Agent, or Firm*—Albert L. Gabriel

[57] ABSTRACT

An improved, belt-driven stern drive for boats of the type sometimes referred to as an "inboard-outboard" or a "through-transom" drive. The invention includes a wide, thin, highly-tensioned power drive belt disposed in a housing having an upper power input portion, a lower prop shaft hub portion, and intermediate housing fins. The housing is vertically, transversely split so as to provide quick-change access to belt and/or gears and for belt tensioning camming movement, the forward and rearward housing sections cooperating to provide wide (in the front-rear direction), laterally thin, hydrodynamically contoured intermediate housing fins having good front-rear shear strength. Lateral strength of the fins is enhanced by a cavitation plate associated with the fins so as to provide lower and upper flow tunnels between the fins for "force feeding" the prop and minimizing drag. Other novel features include a longitudinally (front-rear) staggered relationship between the hub and cavitation plate to minimize turbulence of water flowing to the prop; cavitation plate support member; electromechanical power trim and tilt mechanism; floating drive shaft housing member allowing for some engine misalignment and cooperating with the belt tensioning device in one embodiment; and a lubricating system providing a solid flow of oil to the bearings in the drive.

21 Claims, 19 Drawing Figures

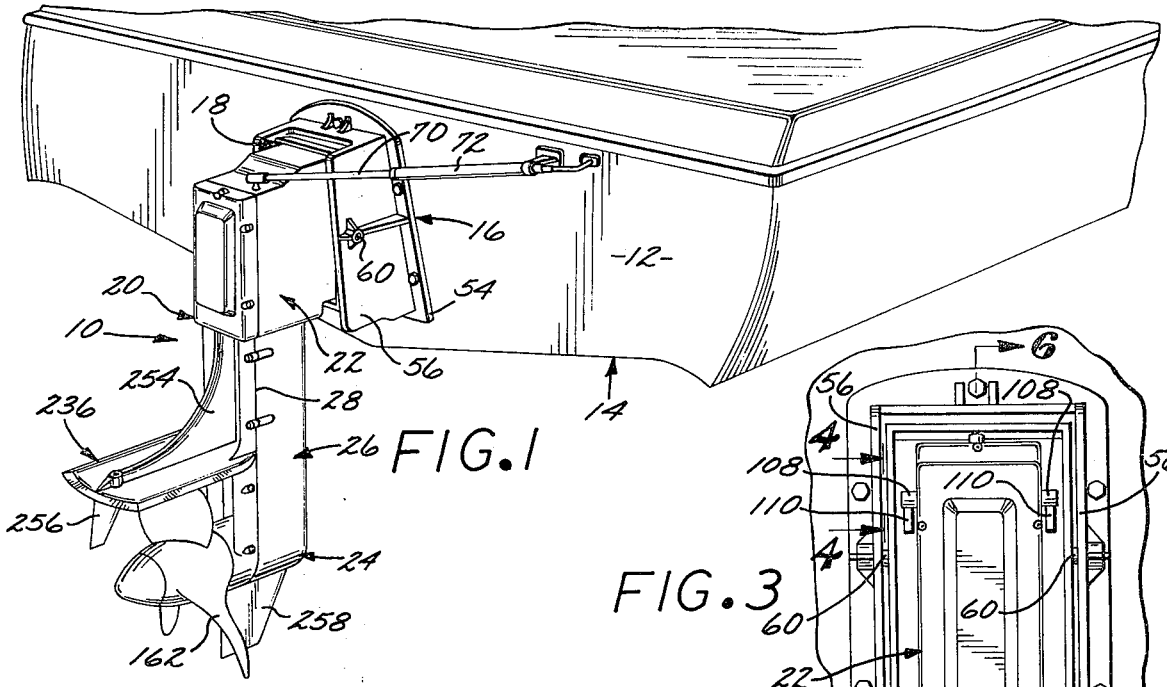
FIG. 1
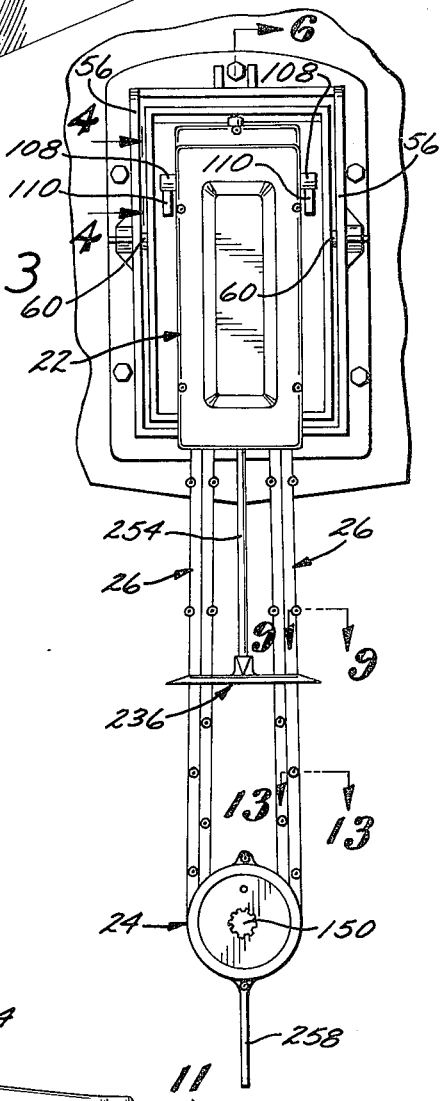
FIG. 3
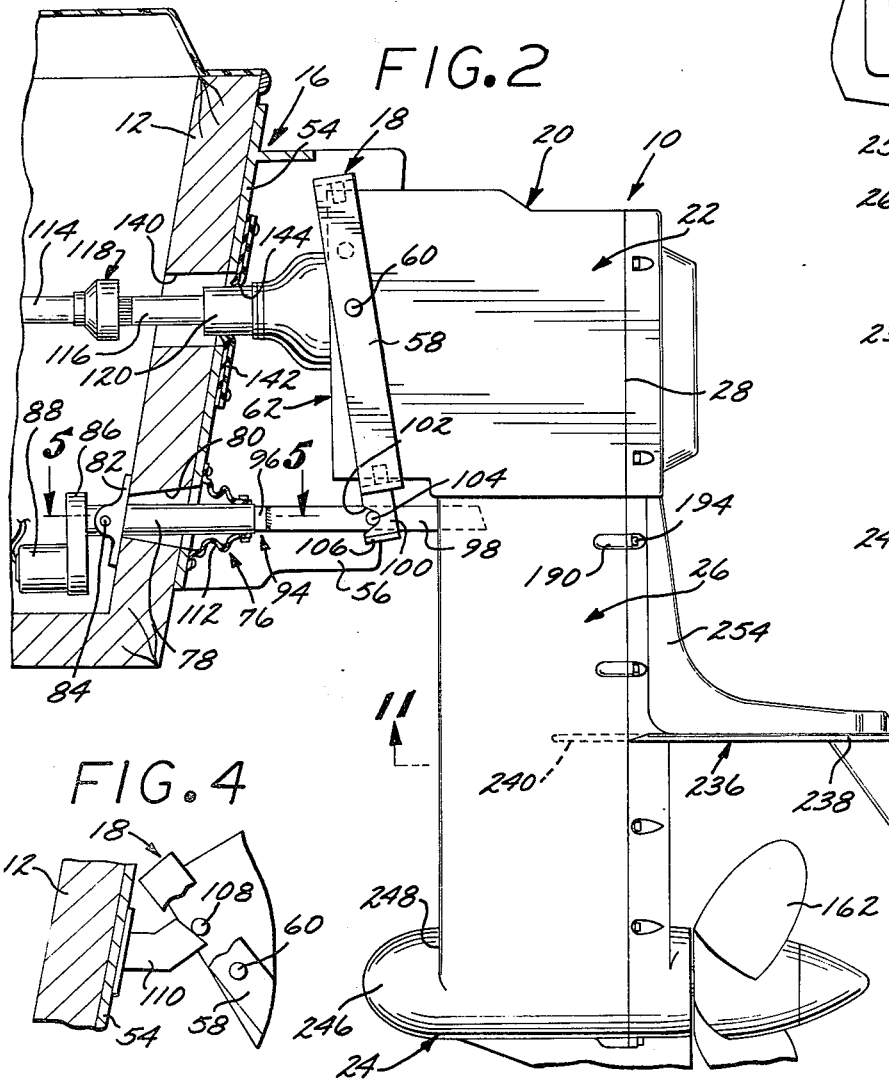
FIG. 2
FIG. 4

FIG. 11
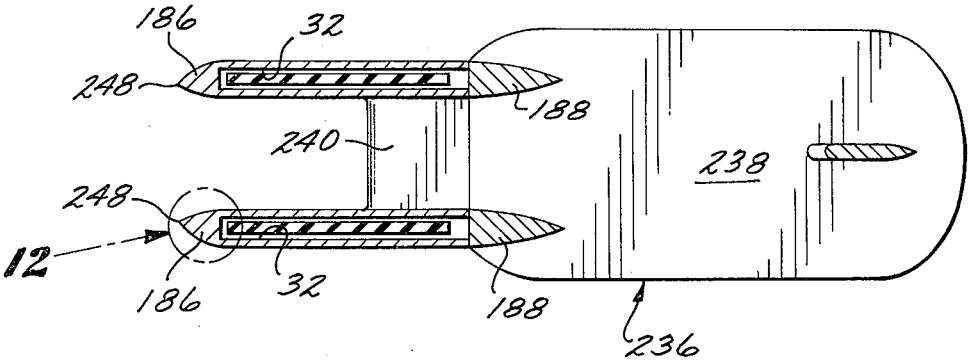
FIG. 12
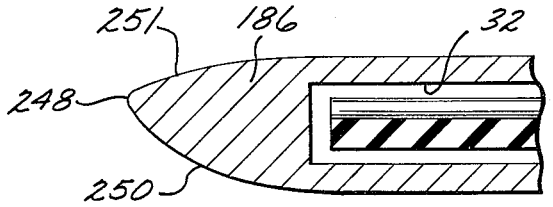
FIG. 13
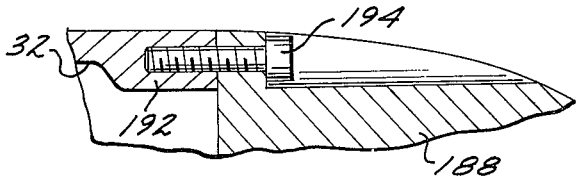
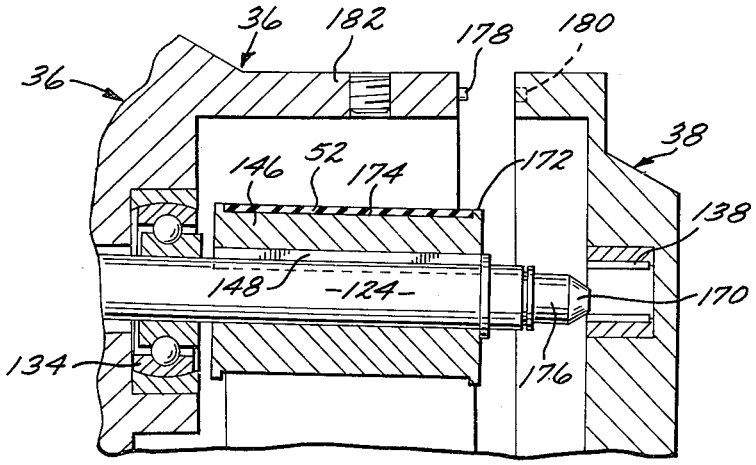
FIG. 14
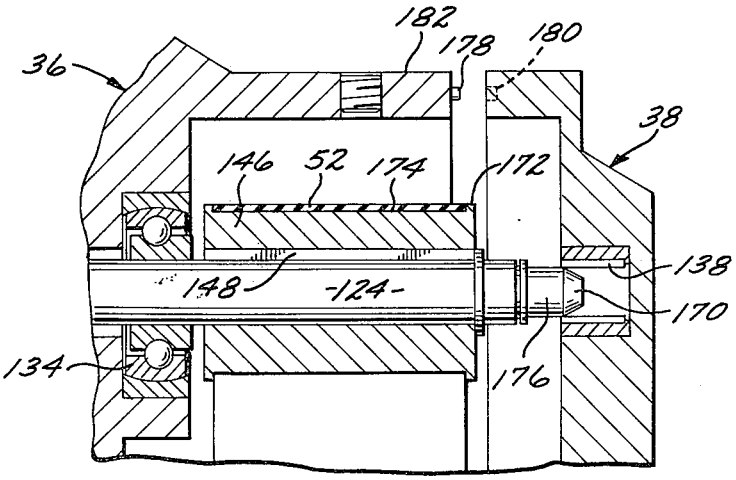
FIG. 15

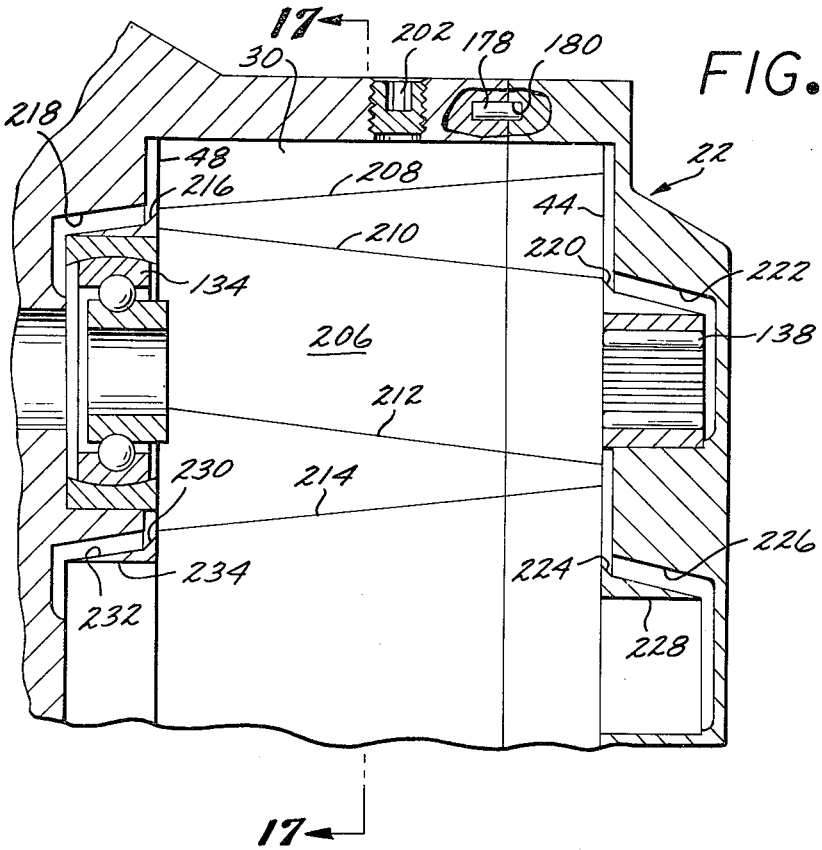
FIG. 16
FIG. 19
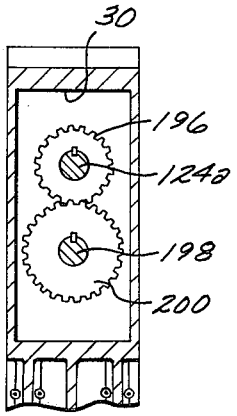
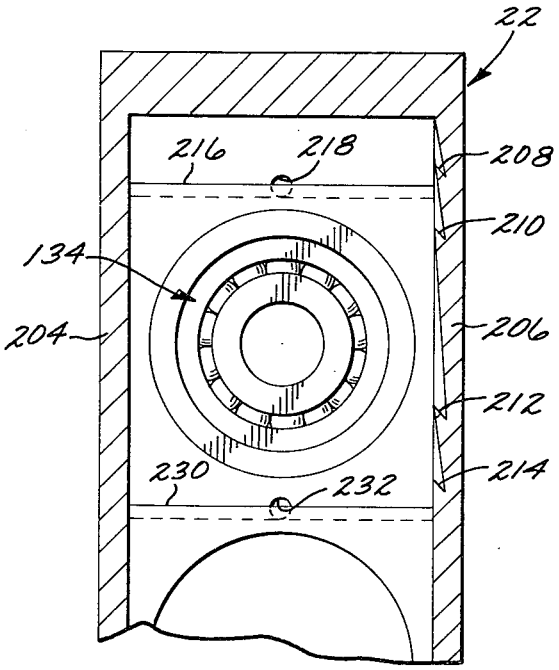
FIG. 17
FIG. 18
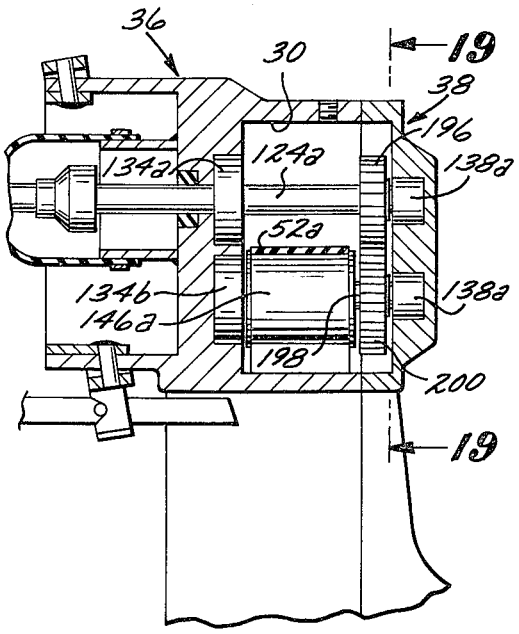

MARINE DRIVE SYSTEM

BACKGROUND OF THE INVENTION

Almost all present day stern drives are of the type having a solid, generally upright drive column through which the power is transmitted by shaft and bevel gear means. Thus, such conventional stern drives have a substantial width of shaft housing in front of the prop, causing turbulence and loss of prop efficiency.

A generally horizontally arranged cavitation plate disposed just above the prop is an essential element of any modern high-performance stern drive, and in the conventional shaft and bevel gear type stern drive such cavitation plate normally extends from proximate the leading edge of the solid drive column along the sides thereof and extending rearwardly over the prop. A further problem in such conventional stern drives is that the body of water that sweeps up behind the boat when it is moving rapidly requires the provision of a second, upper horizontal plate that is spaced above the cavitation plate and which serves as a deflector to hold down the up-swept water. This second plate causes much of the up-swept water to be diverted laterally behind the solid drive column, creating substantial additional drag.

Another problem in conventional stern drives is that the substantial width required for the solid drive column precludes any thin fin-like configuration thereof within allowable front-rear length limitations for truly clean hydrodynamic passage through the water, or for effective functioning thereof as a rudder or keel means.

A still further problem in connection with conventional stern drives is the use of separate hydraulic trim and tilt mechanisms which have exposed hoses. Hydraulic feedback generally causes the trim to be altered by changes in boat speed, RPM and the like, requiring the operator to be continually readjusting the trim. The conventional swing-up release associated with such mechanisms is a one-way hydraulic valve means that normally will not trim back to the same setting.

A variety of belt-driven stern drives have been proposed for many years, but none of these have been truly successful or competitive with other types of boat drives. A principal reason for the failure of most prior art belt-driven sterm drives is that the construction thereof precluded clean hydrodynamic lines, so that they generally produced excessive drag in the water. In particular, the construction of such prior art belt-driven marine drives was generally such as to produce substantial turbulence in the water flow to the prop if the drive components were forward of the prop, causing poor prop efficiency and likelihood of prop burn. This in some instances caused the makers of such prior art belt drives to place the prop forward of the drive components, which is not presently acceptable because of the likelihood of prop damage from underwater obstructions.

A further problem in connection with prior art belt drive attempts of this type was that there was no satisfactory means disclosed in the art for introducing high tension forces into the belt, whereby the employment of a very wide, thin, steel cable reinforced belt of the type capable of transmitting large amounts of power under high belt tensioning was precluded.

A further problem in connection with prior art belt-driven stern drives was that they had no satisfactory means for providing access to the belt such that the belt could be readily inserted into and removed from the drive; and in particular there was no means disclosed in such prior art which would enable a continuous power drive belt of the wide, thin, cable-wound type required for large power transmitting to be inserted and removed as a continuous, unseparable loop.

OBJECTS AND SUMMARY

In view of these and other problems in the art, it is a general object of the present invention to provide a novel belt-driven stern drive which is hydrodynamically clean, presenting a minimum of frontal area to the water and having a minimum of drag; which is highly efficient in transmitting power from an inboard engine to a propeller, being particularly efficient not only in the belt drive means which transmits power from the upper to the lower part of the drive, but also maximizing prop efficiency by providing a generally non-turbulent body of water to the prop; and which has particularly good steerability in operation.

Another object of the invention is to provide a belt-driven stern drive of the character described which embodies a novel dual flow tunnel arrangement wherein upper and lower flow tunnels are separated by a cavitation plate extending as a strut between spaced housing fins. In connection with this cavitation plate, it is also an object to provide a novel sequential arrangement in the longitudinal (front-rear) direction between an expander at the front of the prop shaft hub, the leading edges of the housing fins, and the leading edge of the cavitation plate, which minimizes turbulence in the flow of water fed to the prop through the lower tunnel.

Another object of the invention is to provide novel vertically split housing means providing easy access to the inside of the housing for quick belt or gear changes.

Another object of the invention is to provide novel means for providing a large amount of tension in a wide, flat power transmitting belt in a stern drive of the character described without the need for special tools, and which does not require the application of any excessivie amount of manual force.

Another object is to provide a novel electromechanical power trim and tilt mechanism in a stern drive of the character described.

A still further object of the invention is to provide novel floating drive shaft housing means in a stern drive of the character described which simplifies engine mounting by allowing compensation for some engine misalignment.

According to the invention, rotary power is transmitted in the stern drive by means of a continuous, wide, thin, highly tensioned power transmitting belt through a generally upright housing from an upper power input portion of the housing to the prop shaft in a lower hub portion of the housing, through a pair of vertically elongated, longitudinally wide (in the front-rear direction), but laterally thin intermediate housing fins. The housing is vertically split at an interface arranged to communicate with the cavities in all three of these vertically arrayed housing portions, being located intermediate the front and rear confines of the housing fin cavities, the housing preferably comprising unitary front and rear housing sections which come together at the interface. The split housing enables quick belt and gear changes to be made; provides novel belt tensioning camming movement during engagement thereof; permits long (in the front-rear direction) hydrodynamically contoured leading and trailing portions of the intermediate housing fins for good shear strength of the drive in the direction of maximum stress while at the same time providing an optimum fluid flow contour; and provides support for a cavitation plate extending as a structural strut between the housing fins.

The cavity between the fins is divided in a novel way by the cavitation plate into upper and lower tunnels, the lower "force feeding" a solid body of water to the prop and the upper tunnel providing relief for water which sweeps up behind the boat, both tunnels serving also to enhance steerability of the drive. A novel longitudinally staggered (in the front-rear direction) arrangement of the hub expander, the leading edges of the fins, and the leading edge of the cavitation plate minimizes the effects of turbulence-inducing factors for delivery of generally non-disturbed laminar flow water to the lower tunnel for feeding the prop.

Other features of the invention described hereinafter in detail include a novel cavitation plate support rib associated with the rearward housing section and upper tunnel; electromechanical power trim and tilt mechanism allowing accurate relocation of the drive in its operative position after tilt-up, and having guide blade means cooperating with the upper tunnel; and novel floating drive shaft housing means allowing compensation for some misalignment and cooperating with the belt tensioning means in a non-geared embodiment of the drive.

Other objects, aspects and advantages of the present invention will be apparent from the following description taken in connection with the accompanying drawings, wherein:

BRIEF DESCRIPTION OF THE DRAWINGS

FIG. 1 is a perspective view illustrating a beltdriven stern drive according to the present invention mounted on the transom of a boat, and operatively disposed in its driving position.

FIG. 2 is a side elevational view of the stern drive shown in FIG. 1, with the boat and transom seals shown in longitudinal, vertical section.

FIG. 3 is a rear elevational view of the present drive, with the prop removed for a complete illustration of the bottom portions of the housing.

FIG. 4 is a fragmentary side elevational view, with portions shown in section, and with other portions broken away, illustrating a tilt stop mechanism for the drive.

FIG. 11 is a horizontal section taken on the line 11—11 in FIG. 2.

FIG. 12 is an enlarged, fragmentary horizontal section constituting an enlargement of the encircled region of FIG. 11.

FIG. 13 is an enlarged, fragmentary horizontal section taken on the line 13—13 in FIG. 3.

FIG. 14 is an enlarged, fragmentary, vertical, axial (in the front-rear direction) section, partly in elevation, illustrating the manner in which the stern drive input shaft is tilted on its self-aligning forward bearing, for removable mounting of the belt in the drive before tensioning of the belt.

FIG. 15 is a view similar to FIG. 14, but after the stern drive input shaft has been cammed upwardly by engagement of the housing sections toward each other into the belt tensioning position.

FIG. 16 is an enlarged, fragmentary, vertical, axial (in the front-rear direction) section of the upper portion of the drive housing, illustrating novel oil capturing and distribution means for providing solid oil to the shaft bearings.

FIG. 17 is a transverse vertical section taken on the line 17—17 in FIG. 16 showing further details of the lubrication system.

FIG. 18 is a vertical, longitudinal (in the front-rear direction) section, with portions in elevation, illustrating a geared embodiment of the invention.

FIG. 19 is a transverse vertical section taken on the line 19—19 in FIG. 18.,

DETAILED DESCRIPTION

Figure 6:
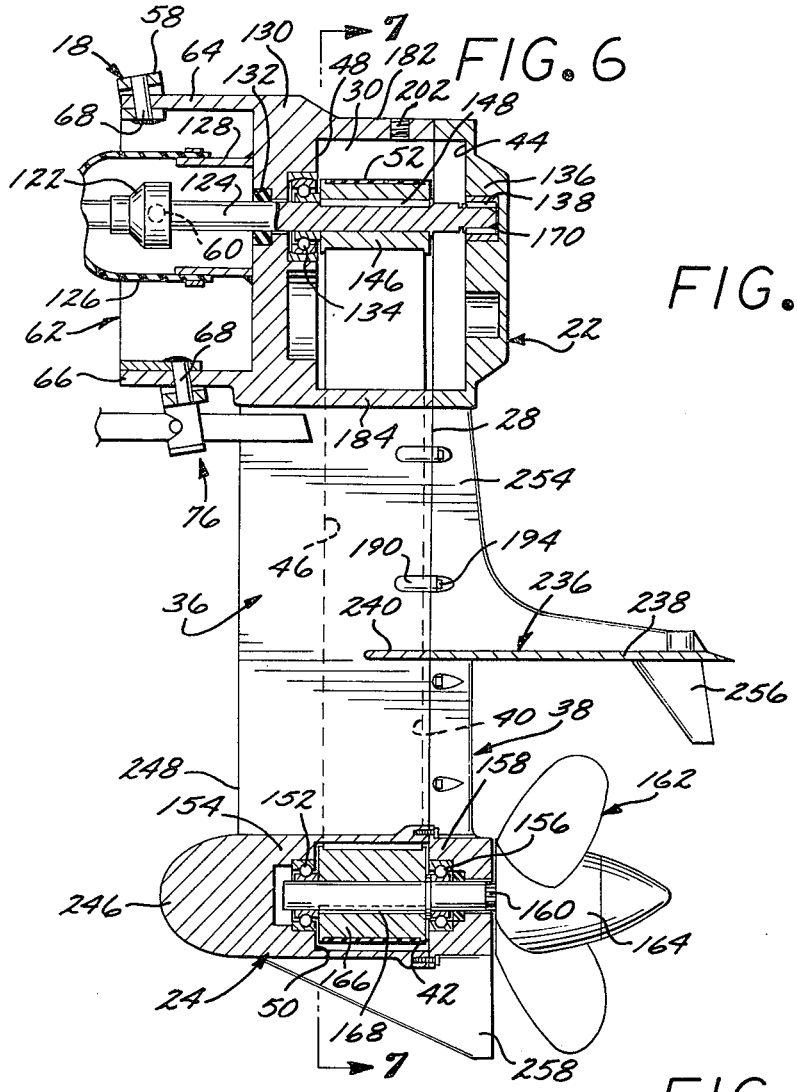
FIG. 6 is a vertical, longitudinal (in the front-rear direction) section taken on the line 6—6 in FIG. 3.

Referring to the drawings, and at first particularly to FIGS. 1, 2 and 3 thereof, a stern drive according to the invention is generally designated 10, and is of the type sometimes referred to as an inboard/outboard or a through-transom drive. The stern drive 10 is supported to the rear of the transom 12 of a boat 14, generally along an extension of the axial center of the boat, by means of mounting structure 16 connected to the transom 12 and gimbal means 18 which has suitable pivotal connections to the mounting structure 16 and to the upper portion of the stern drive housing 20. The drive is shown in FIGS. 1, 2 and 3 in a generally upright position corresponding to a normal operative driving position. The gimbal mounting enables the drive to be pivoted about a horizontal axis in the front/rear direction for tilting rearwardly and upwardly upon encountering underwater obstructions and for land transport, as well as for trimming, and also permits pivoting about a generally vertical axis so that the drive can swing to the right and to the left for steering purposes.

THE VERTICALLY SPLIT HOUSING

The housing 20 includes an upper housing or body portion 22 disposed substantially above the bottom of the boat 14 and which provides the mounting connection to the gimbal means 18, a lower housing portion 24 disposed below the level of the bottom of the boat 14 and which is a generally bullet-shaped stationary hub in which the propeller shaft is rotatably mounted, and a pair of vertically elongated, generally parallel intermediate housing fins 26 which extend downwardly from the upper housing portion 22 to the lower housing portion 24.

The housing 20 is split at a generally transverse, vertical interface 28 to provide access to an upper housing chamber 30 in the upper housing portion 22, to a pair of elongated, generally flat intermediate housing chambers 32, and to a generally cylindrical lower housing chamber 34, the housing chambers 30, 32 and 34 all being in communication with each other. Thus, the housing 20 includes two separate sections which come together at the generally vertical, transverse interface 28, a forward housing section 36 and a rearward housing section 38.

The interface 28 between holding sections 36 and 38 is preferably a flat, planar interface so as to simplify machining and also to simplify and optimize sealing engagement between the housing sections 36 and 38. For optimum strength and simplicity, and also to minimize sealing problems, it is preferable that each of the forward and rearward housing sections 36 and 38, respectively, be unitary structures. Thus, it is preferable that the upper portion 22, lower portion 24, and intermediate fin portions 26 of the forward housing section 36 all be of unitary construction; and that the upper portion 22, lower portion 24, and intermediate fin portions 26 of the rearward housing section 38 also all be of unitary construction.

Figure 8:
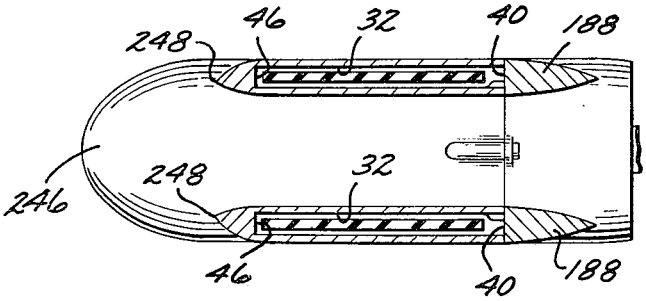
FIG. 8 is a horizontal section taken on the line 8—8 in FIG. 7.
Figure 10:
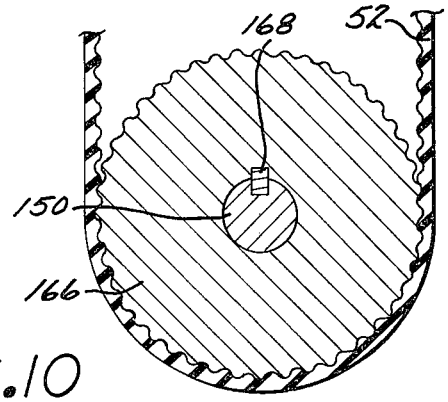
FIG. 10 is an enlarged, fragmentary transverse section illustrating the drive belt and driven pulley associated with the propeller shaft.

While the interface 28 is shown in the drawings as being located generally rearwardly in the housing, it is to be understood that it may be located at any position in the frontrear direction so long as it provides continuous communication along its vertical length with the upper housing chamber 30, the pair of elongated, intermediate housing chambers 32, and the generally cylindrical lower housing chamber 34. Thus, as best seen in FIGS. 6 and 8, the rearwardmost position of the interface 28 that will provide access to all three of the housing chambers 30, 32 and 34 is at the rear vertical surface 40 forming part of the definition of the intermediate housing chambers 32, and the substantially coplanar rear surface 42 of the generally cylindrical lower housing chamber 34. It will be noted that the rear surface 44 of the upper housing chamber 30 is spaced substantially to the rear of this rearwardmost position for the interface 28; this is to accommodate gears in a geared embodiment of the drive as illustrated in FIGS. 18 and 19.

Conversely, the forwardmost position that is acceptable for the interface 28, i.e., the forwardmost position of the interface 28 that will provide access to all three of the housing chambers 30, 32 and 34, is at the front vertical surfaces 46 of the intermediate housing chambers 32. The front surface 48 of upper housing chamber 30 and the front surface 50 of lower housing chamber 34 may, as illustrated in FIG. 6, be disposed proximate this forwardmost position for the interface 28 between the forward and rearward housing sections 36 and 38, respectively.

The continuity of communication between the housing chambers 30, 32 and 34, coupled with the accessibility to all of the housing chambers 30, 32 and 34 at the interface 28 by thus limiting the forward-rearward position of the interface 28, enables the use of a continuous, non-severable drive belt 52 for transmitting rotary power from the upper housing chamber 30 to the lower housing chamber 34, which drive belt 52 is of the molded type embodying an elastomeric body having molded therein a continuous helix of steel cable such as to be capable of transmitting large amounts of horsepower as required in a modern stern drive.

THE MOUNTING STRUCTURE

The stern drive 10 may be gimbal mounted in either of two ways: (1) as illustrated in FIGS. 1 to 3, 6 and 18 of the drawings wherein the gimbal member is connected to the transom mounting on horizontal pins or trunnions for pivoting about a horizontal axis, and the body of the stern drive is connected to the gimbal member by generally vertical pin or trunnion means for swinging about a generally vertical axis, in which case a direct steering connection is provided to the body of the stern drive, and a power tilt and trim mechanism may be applied to the gimbal member; or (2) in an arrangement wherein the gimbal member is connected to the transom mounting structure on generally vertical pin or trunnion means for pivoting about a generally vertical axis, and the body of the stern drive is connected to the gimbal member by generally horizontal pin or trunnion means for swinging about a generally horizontal axis, in which case "internal steering" may be employed by providing a direct steering connection to the gimbal member rather than to the stern drive housing, and in which case the power trim and tilt mechanism must connect directly to the stern drive body.

Referring to FIGS. 1 to 6 of the drawings, in the illustrated mounting for the stern drive 10, the mounting structure 16 includes a base plate 54 that is attached flush against the rear or outer surface of transom 12 by bolts or other suitable fastening means, with a pair of generally flat, parallel side plates 56 projecting rearwardly from the base plate 54. The gimbal means 18 includes a gimbal member 58 in the form of a generally rectangular housing which is pivotally connected to the side plates 56 of mounting structure 16 by means of pins or trunnions 60 so as to pivot about a generally horizontal axis. The forward housing section 36 includes forwardly extending mounting structure 62 proximate the upper housing portion 22 that includes a pair of vertically spaced, generally horizontal wall portions 64 and 66 that are pivotally connected to the gimbal member 58 by pins 68 so that the drive 10 will swing about a generally vertical axis.

While the gimbal member 58 has been shown as a generally rectangularly shaped gimbal housing, it will be understood that the gimbal member may be ring-shaped, yoke-shaped, or may be of any other conventional gimbal member configuration.

This gimbal mounting of the stern drive 10 is preferably arranged to permit a rearward up-tilt of the drive 10 of about 40° or more so as to allow the drive to completely clear the bottom of the boat; and to permit the drive to swing about the generally vertical pivot axis about 35° or more to either side of the centered position for maximum steering effectiveness.

Steering movement is applied to the stern drive 10 by means of a steering rod 70 slidably supported in a guide sleeve 72, the steering rod 70 being releasably pivotally connected at its free end to the body 22 of the housing, while the guide sleeve 72 is pivotally supported on the transom 12. Actuation of steering rod 70 is provided by means of steering cable 74 suitably coupled by conventional means to a helm on the boat 14.

THE ELECTROMECHANICAL TRIM AND TILT MECHANISM

A novel unitary electromechanical power trim and tilt mechanism is provided as seen in FIGS. 2, 4 and 6, this trim and tilt mechanism including guide means that cooperates with the upper tunnel portion defined between the intermediate housing fins 26.

The power trim and tilt mechanism is generally designated 76, and includes a sleeve member 78 which extends through a rearwardly flaring aperture 80 in transom 12 and mounting base plate 54. A bracket 82 mounted on the forward face of transom 12 is apertured to receive the sleeve member 78 therethrough, the sleeve member 78 being pivotally connected to bracket 82 by pin 84 permitting sleeve member 78 to rock about a horizontal axis in a generally vertical plane generally longitudinally of the boat. A gear housing 86 is affixed to the front end of sleeve member 78, and reversible electric motor 88 is connected to the gear housing 86. A worm drive gear 90 is disposed in gear housing 86 so as to be reversibly driven by the electric motor 88, the worm drive gear 90 being fixedly connected to the forward end of a worm shaft 92 that extends rearwardly through sleeve member 78.

A tilt and trim shaft 94 includes a forwardly opening, internally threaded tubular forward portion 96 threadedly engaged over the worm shaft 92 in sleeve member 78; the shaft 94 also including an integral rearward portion 98 in the form of a flat bar. The bar 98 extends through a complementary aperture in a pair of spaced, parallel ears 100 that depend from the bottom of gimbal member 58 as shown in FIG. 2, the ears 100 being forwardly notched at 102 to receive pins 104 projecting laterally from the flat sides of the bar 98 intermediate the length of the bar 98.

In order to assure that the bar 98 will at all times track between the ears 100, the aperture between the ears 100 is closed by bottom plate 106, and the bar 98 projects rearwardly a sufficient distance behind the pins 104 so that even with the tilt and trim shaft 94 in its forwardmost position in sleeve member 78, when the stern drive 10 is tipped rearwardly and upwardly its maximum amount, the bar 98 will remain engaged between the ears 100. This requires that the rearward extension of bar 98 be so long that it must be accommodated in the upper portion of the tunnel defined between the housing fins 26. The uppermost limit of tilting movement of the stern drive 10 is defined as shown in FIGS. 3 and 4 by engagement of a pair of stop pins 108 on the sides of drive body 22 against a corresponding pair of stop members 110 extending rearwardly from the base mounting plate 54.

Figure 7:
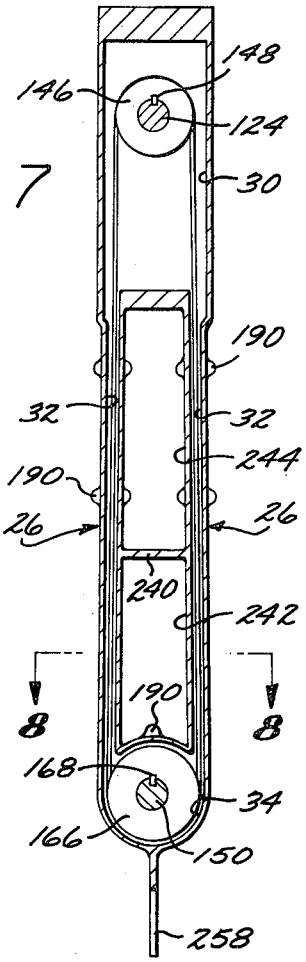
FIG. 7 is a transverse vertical section taken on the line 7—7 in FIG. 6.

The transom aperture 80 is sealed by engagement of an accordioned boot member 112 between the base plate 54 and the sleeve member 78 as shown in FIG. 7.

In the normal drive position of the stern drive 10 as illustrated in the drawings, the power trim and tilt mechanism 76 is operated as a trimmer to trim the stern drive 10 for the optimum propeller thrust line. Such trimming is accurate and fine, and is also self-locking because of the low gear ratio of the worm drive connection between worm shaft 92 and the forward portion 96 of tilt and trim shaft 94. Energization of the electric motor 88 in one direction will cause the worm shaft 92 to draw tilt and trim shaft 94 forwardly, thus moving the pins 104 forwardly and allowing the gimbal member 58 and hence the stern drive 10 to tilt forwardly. Reverse movement of the electric motor 88 will cause an opposite rotation of worm shaft 92 so as to drive the tilt and trim shaft 94 rearwardly and thereby cause the stern drive 10 to tilt more rearwardly. During such rotational movements of the worm shaft 92 the engagement of the flat bar portion 98 of tilt and trim shaft 94 between ears 100 will hold the shaft 94 against rotation.

Operation of the power trim and tilt mechanism 76 as a tilt mechanism as distinguished from a tilt mechanism simply involves energization of the electric motor 88 for a longer period of time so as to drive the tilt and trim shaft 94 between a generally retracted position as illustrated in FIGS. 1, 2 and 6 of the drawings, and an extended position in which the stern drive 10 is tilted all of the way up to the stop as illustrated in FIG. 4.

The releasable engagement of the pins 104 in the ear notches 102 allows the stern drive 10 to be swung up manually between the drive position and the up-tilt position, without energization of the electric motor 88, and also allows the drive to automatically tilt rearwardly and upwardly upon encountering an underwater obstruction during operation. The extended rearward portion of the bar 98 as accommodated in the upper tunnel portion between the housing fins 26 in the operative position of the drive as shown in FIGS. 2 and 6 enables the bar 98 to remain at all times engaged between the ears 100 so as to act as a guide blade regardless of rearward tilting of the drive 10 by either manual tilting or engagement with an underwater obstruction.

It will thus be apparent that the power trim and tilt mechanism 76 of the present invention is simple both structurally and in operation, providing positive positioning of the drive in both trim and tilt operations, and providing a clean-cut release for rearward swinging of the drive that enables the drive to reliably return to the same operative position. As compared with conventional hydraulic trim mechanisms wherein hydraulic feedback causes the trim to be changed by changes in boat speed, RPM and the like so that the operator must be continually readjusting the trim, the present power trim and tilt mechanism 76 provides positive location of the stern drive 10 on its tilt axis so as to avoid the need for such constant readjustment of trim. As compared with the conventional one-way hydraulic valve swing-up release that generally does not trim back to the original setting, the present swing-up release will always positively relocate to the same setting. Additionally, the present power trim and tilt mechanism 76 is considerably simpler than conventional hydraulic systems which involve separate trim and tilt mechanisms that generally require exposed hoses.

THE POWER TRAIN TO THE STERN DRIVE

Referring now primarily to FIGS. 2 and 6 of the drawings, rotary power is provided from an inboard engine (not shown) inside the boat through a transmission (also not shown) having reverse gear means therein, and which, if desired, may also have variable forward gear ratio means therein such as a torque converter, change-speed gears, or a combination thereof. By having the transmission associated directly with the engine in the boat, the size and complexity of the stern drive 10 are minimized. However, it is to be understood that reversing gear and other variable drive means may, if desired, be embodied in a stern drive according to the present invention.

The engine-transmission power output shaft 114 supplies rotary power to a drive shaft 116 through a self-aligning connector 118 which will allow several degrees of misalignment between the shafts 114 and 116. The self-aligning connector 118 may, if desired, be of the type having a gear within an internally toothed housing. The connection between drive shaft 116 and connector 118 is a severable connection, the drive shaft 116 having a splined end that is removably engageable in a splined receptacle in the connector 118. The severability of this connection facilitates mounting and dismounting of the stern drive 10, and the splined connection also accommodates some relative longitudinal movement as required between the shafts 114 and 116.

The drive shaft 116 extends through a cylindrical floating housing 120 and is drivingly connected by means of a constant speed universal joint 122 to stern drive input shaft 124 which is rotatably supported in the body or upper housing portion 22, extending through the upper housing chamber 30 as best seen in FIG. 6. A flexible elastomeric boot 126 provides a seal for the universal joint 122, being clamped at its forward end over the floating housing 120, and being clamped at its rearward end over a sleeve 128 which projects forwardly from the forward wall 130 of upper housing portion 22. The universal 122 is located at the intersection of the pivot axes of gimbal pins 60 and 68.

The stern drive input shaft 124 extends from universal joint 122 rearwardly through a flexible seal 132 disposed in the front of wall 130, and is supported in the forward wall 130 on a self-aligning bearing 134, and in the rear wall 136 of upper housing portion 22 in needle bearing 138.

THE FLOATING DRIVE SHAFT HOUSING

Referring again to FIG. 2, an aperture 140 is provided through the transom 12 that is considerably larger in diameter than the floating housing 120, so as to allow substantial freedom of movement of the floating housing 120 in planes generally normal to its axis. Movable sealing means also allowing such freedom of movement of the floating housing 120 is engaged between the transom and the floating housing 120, this sealing means also being arranged to allow the floating housing 120 to be readily inserted therein and removed therefrom. Suitable sealing means for this purpose comprises a plurality of layered elastomeric sheets 142 secured flush against the base mounting plate 54 and having apertures 144 that are substantially smaller in diameter than the floating housing 120 so that the sheets 142 are stretched in sealing engagement over the floating housing 120.

Historically, one of the difficult problems in connection with stern drives has been a requirement of substantially exact alignment between the inboard engine and the outboard stern drive. The present floating drive housing 120 in combination with the self-aligning connector 118 allows for some misalignment between the engine-transmission assembly and the stern drive 10, thereby avoiding this heretofore difficult problem of engine alignment, and cutting engine installation time materially.

As will be seen hereinafter, the floating shaft housing 120 also cooperates in the direct belt drive (non-geared) embodiment of the present stern drive, as illustrated in FIGS. 6, 7, 14 and 15, to allow some downward tilting of the input shaft 124 which is employed in the installation of the power drive belt 52 and the tensioning thereof to its "theoretical center".

THE BELT DRIVE AND ASSOCIATED THIN HOUSING FINS

Referring to FIGS. 6 and 7, in the direct or non-geared belt drive embodiment, belt drive sprocket 146 is mounted on the input shaft 124, being keyed thereto by the key 148. Axially centrally mounted within the generally cylindrical bullet-shaped lower housing portion 24 is the prop shaft 150, shaft 150 being supported for rotation in a front bearing 152 located in forward wall 154 of lower housing portion 24, and in rear bearing 156 located in rear wall 158 of lower housing portion 24. The prop shaft 150 continues rearwardly through packing 160 disposed behind the rear bearing 156, with propeller 162 being supported upon an exposed rearward portion of the shaft 150. The propeller 162 includes hub 164 which is shaped as a rearwardly constricting continuation of the bullet-shaped fixed hub of the lower housing portion 24. Driven belt sprocket 166 is drivingly keyed to the prop shaft 150 by means of key 168.

The drive belt 52 that is employed in the present stern drive 10 is especially adapted for the transmission of power, and is of a novel wide but very thin configuration which uniquely adapts it for the "tunnel drive" arrangement of the present stern drive 10, permitting a minimum thickness of the intermediate housing fins 26 between which the tunnel is defined, and thereby permitting a minimum of frontal area of the stern drive 10 presented to the water during operation. With this type of wide but very thin power transmitting belt 52, increases in the amount of power transmitted thereby to the propeller are accommodated simply by corresponding increases in the width of the belt without any increase in the thickness of the belt, whereby such minimum thickness of the housing fins 26, and hence minimum frontal area, is maintained regardless of the size of the engine employed in connection with the stern drive 10. Any added belt width required by larger engine horsepower is accommodated in the present drive simply by increasing the width of the housing 20 in the front-rear direction, to provide increased widths in the front-rear direction for the housing chambers 30, 32 and 34 so as house the longer pulleys 146 and 166 and the drive belt 52. The only difference seen by the flowing water during operation of the stern drive 10 would then be the wider housing fins 26 and longer tunnel defined therebetween, and the longer bullet-shaped lower housing portion 24, and these would cause no more than minimal increases in the frictional drag through the water.

In a typical stern drive installation having an inboard engine rated at about 165 H.P., the drive belt 52 need only be about four inches wide, and will have a thickness of only about ¼ inch, including a backing of approximately ⅛ inch and teeth approximately ⅛ inch high. A belt of the same thickness about five inches wide will accommodate an engine of approximately 200 M.P.

A suitable power transmitting belt of this type is the "Uniroyal Powergrip High Torque" belt. In this type of belt the tooth profiles having a rounded shape to provide substantially improved stress distribution as compared with conventional timing belts. The teeth are arranged to make positive engagement with mating rounded axial grooves on the pulleys, the teeth entering and leaving the grooves in a smooth, rolling manner with negligible friction. Any important factor in the power transmitting efficiency of this type of belt is that it does not depend upon thickness to develop and maintain great tensile strength for transmitting large amounts of power, and it can thereby be very thin so as to both negate heat buildup and to permit a minimum frontal area of the intermediate housing fins 26, without sacrificing its power to grip and pull.

The pulling or load-carrying element of the belt 52 of this type consists of helically wound steel cables which have excellent flex life and are highly resistant to elongation. A durable, flexible neoprene backing encases and is bonded to the cables, for a total backing thickness of only about ⅛ inch, this neoprene backing protecting the cables from grime, oil and moisture. Integrally molded with such neoprene backing are neoprene teeth which are made of a shear-resistant, moderately hard neoprene compound. These teeth are precisely formed and spaced for correct engagement with the complementary pulley grooves so as to distribute the power loading over all engaged teeth and grooves. The teeth are so located that the tooth root line lies substantially on the pitch line, whereby the tooth spacing (circular pitch) of the belt is not altered by flexing. In a typical belt of this type, the belt tooth strength actually exceeds the tensile strength of the cable when six or more teeth are uniformly in mesh with a pulley, which enables the driven pulley or sprocket 166 to be sufficiently small for the lower housing portion 24 to not be required to be substantially larger in diameter than the conventional prop hub size for the hub 164, permitting clean hydrodynamic flow from the fixed lower housing hub 24 on the rotating pump hub 164.

A tough nylon fabric facing with low coefficient of friction covers the teeth of the drive belt 52 and protects the working surfaces of the teeth.

This type of wide, thin power drive belt 52 is, when manufactured, molded with the continuously helically wound cables therein under substantial tension, the belt being molded on a particular "theoretical center" distance. When the belt 52 is installed in driving position on the pulleys 146 and 166, it must be under tension that is on the order of hundreds of pounds in order for the belt 52 to be brought back up to this "theoretical center", which is a requirement of belt installation for this type of drive belt in order to transmit the large amounts of horsepower involved. In order to avoid the need for special prying tools or heavy equipment to install the belt 52 with such large amount of tensioning, and to thereby permit easy installation and removal of the belt both in the shop and in the field without special tools, and in a minimum of time, some means must be embodied in the stern drive 10 for applying such tensioning after the belt 52 is engaged over the pulleys or sprockets 146 and 166. Such belt tensioning means may take the form of one or more idler rollers engaged against the belt. However, such idler pulleys add undesired frictional power loss in the drive train, and also would require a substantial increase in the size of the stern drive 10. Such size increase would not only be undesirable from the standpoint of appearance, but would make it extremely difficult to maintain the extremely thin cross sections of the intermediate housing fins 26, which is an important factor in the hydrodynamics of the present drive. Thus, any tensioning idler roller means that would tend to apply lateral deflection of one or both sides of the loop of belt 52 as viewed in FIG. 7 would require a substantial increase in the thickness of the intermediate housing chambers 32 to accommodate the deflection without the belt rubbing on the housing, thereby requiring an increase in the thickness of the fins 26. As will be apparent from FIGS. 18 and 19, space for any such idler tensioning roller means would be even more difficult to provide in the geared embodiment of the drive.

THE BELT TENSIONING MEANS

Accordingly, the present invention embodies novel belt tensioning means capable of bringing the power drive belt 52 back up to its theoretical center without the need for special tools, and without requiring any large forces to be manually applied, whereby the belt can be readily changed or serviced and whereby gear changes can readily be made in the geared embodiment of the invention.

This belt tensioning means of the present invention includes the self-aligning bearing 134, which allows the shaft 124 supported therein to tilt in a clockwise direction as viewed in FIG. 6; the vertically split feature of the invention wherein the self-aligning bearing 134 is disposed in the forward housing section 36 and the other bearing that supports the shaft 124, needle bearing 138, is disposed in the rearward housing section 38; and a lead-in bevel 170 on the rear end of shaft 124. The self-aligning bearing 134 allows the rearward end portion of shaft 124 to tilt downwardly as illustrated in FIG. 14 when the forward and rearward housing sections 36 and 38, respectively, are completely separated. This downward tilt is sufficient for the relaxed belt 52 to be engaged from the rear forwardly over the pulleys. The rear end peripheral edge 172 of pulley 146 will drop down further than the other portions of the pulley 146, whereby the peripheral edges of the pulley 146 may extend radially beyond the bottoms of the tooth recesses 174 in the pulley 146 for belt location during operation, and yet the belt 52 can be readily engaged over the peripheral edge 172.

Both of the pulleys 146 and 166 remain in their general operative positions on the respective shafts 124 and 150 associated with the forward housing section 36 when the two housing sections 36 and 38 are separated. For installation, the belt 52 is simply slid forwardly into the housing chambers 30, 32 and 34, being engaged over the two pulleys 146 and 166, and then the housing sections 36 and 38 brought together. Forward engaging movement of the rearward housing section 38 toward the forward housing section 36 will first involve engagement of the rearward housing section 38 over the prop shaft 150. Then as the rearward housing section 38 moves forwardly the needle bearing 138 will engage the lead-in bevel 170 on the rear end of shaft 124 and will cam the rear end of shaft 124 upwardly relative to the rear end of prop shaft which is already engaged in the rearward housing section 38. Continued forward movement of rearward housing section 38 relative to forward housing section 36 will then cam the shaft 124 so as to pivot the shaft 124 upwardly about the pivot axis of self-aligning bearing 134 until the cylindrical rear end portion 176 of shaft 124 is engaged within the needle bearing 138 as shown in FIG. 15, at which position the shaft 124 is parallel to the prop shaft 150 and the drive belt 52 is fully tensioned. The forward end rearward housing sections 36 and 38 are then brought together so as to close the interface 28, in which position the cylindrical portion 176 of shaft 124 is fully engaged in the needle bearing 138. If desired, gasket or other sealing means may be interposed between the housing sections at the interface 28.

To assure that equal tension is applied across the belt 52, it is desirable to positively locate the forward and rearward housing sections 36 and 38 relative to each other, both vertically and horizontally. This is accomplished by one or more dowels 178 on one of the housing sections 36 or 38 that is engaged in a complementary bore 180 in the other housing section 36 or 38. Preferably at least one of the dowels 178 and complementary bores 180 are located in the top wall 182 of upper housing portion 22 and also in the bottom wall 184 of upper housing portion 22.

In practice it has been found that it takes an axis shifting toward each other between a pair of pulleys of roughly 0.005 inch to 0.010 inch to relax the power drive belt. In a prototype built according to the principles of the present invention, the self-aligning bearing 134 allowed the rear end portion of shaft 124 to tilt down approximately 0.100 inch with the housing sections separated as shown in FIG. 14, which is a sufficient amount for the fully relaxed belt to be engaged over the pulleys. In this prototype the lead-in bevel 170 was provided with a depth of approximately ⅛ inch, or 0.125 inch, so that the bevel 170 had sufficient depth in this down-tilted position of shaft 124 to be automatically engaged and picked up by the needle bearing 138 when the housing sections were brought together. In the tilted position of shaft 124 as shown in FIG. 14, the pulley 146 is lowered on the average (proximate the center of its axial length) approximately 0.050 inch, which allows adequate room for engagement of the belt 52. When the belt 52 is engaged all of the way onto the pulleys, the forward edge of the belt does start to get tensioned, but this is only such a narrow edge portion of the belt that it does not require substantial force to push the belt all of the way onto the pulleys. Then, as the housing sections are brought together, tensioning of the belt increases from the forward edge across the belt until the tension is substantially uniform all of the way across the belt. In the aforesaid prototype, a bevel angle of approximately 30° relative to the axis of shaft 124 was found to be a sufficiently gentle incline for the belt to be tensioned without undue manual force being required. It will be noted that in addition to the mechanical advantage introduced by the ramp effect of the bevel 170, the center of belt 52 is closer to the self-aligning bearing 134 than it is to the bevel 170 so that more than a 2:1 lever arm advantage will be provided by the shaft 124.

FURTHER FEATURES OF THE HOUSING

Once the housing sections 36 and 38 are closed at the interface 28, and accurately located both vertically and laterally by means of the dowels 178, the housing sections 36 and 38 are secured together by means of a series of bolts spaced about the periphery of the housing. While the housing wall thickness may be sufficient in the upper housing portion 22 to accommodate such screws, the wall thicknesses in the region of the intermediate housing fins 26 may not be sufficient to accommodate such screws. Because of the great structural rigidity imparted to the intermediate housing fins 26 by reason of their great width in the front-rear direction, which is the direction of greatest sheer stress on the housing fins 26 during operation, from the factors of prop driving force, water impacting and drag force, and shocks that may result from encounters of the lower housing hub 24 against underwater obstructions, the walls in the region of the intermediate housing fins 26 which define the sides of the intermediate housing chamber 32 may be relatively quite thin; and the thinner these walls can be made, the narrower the intermediate housing fins can be so as to optimize their hydrodynamic characteristics. In this regard, it is to be noted as best seen in FIGS. 8 and 11 to 13, that the intermediate housing fins 26 are provided with solid front streamlining body portions 186 and solid rear streamlining body portions 188 which add greatly to the structural strength of the intermediate housing fins 26 according to beam construction practices and also cooperate hydrodynamically with the thin housing fins 26.

In the aforesaid prototype, with this construction, it was found that with the housing sections made of cast aluminum alloy, wall thicknesses of approximately 3/16 inch gave sufficient strength in the intermediate housing fins 26 adjacent their chambers 32. In this prototype, a thin chamber width of approximately ½ inch was found sufficient to provide adequate clearance for the drive belt 52, whereby the housing fins 26 were only approximately ⅞ inch thick.

To accommodate the screws, bumps or bosses are formed in the otherwise relatively thin walls of the housing fins 26. In the upper portions of the fins 26 above the cavitation plate, these bumps or bosses may be external, streamlined bumps 190 which are preferably staggered between the outside and tunnel external surfaces of the fins. However, in order to minimize turbulence of the body of water fed between and about the housing fins 26 to the prop 162, it is preferred to employ internal bumps 192 which extend into the fin housing chambers 32 below the cavitation plate, the bumps 192 being staggered between the outer and tunnel walls of the housing fins 26. If such internal bumps 192 are employed, it is preferable to have the interface 28 between the forward and rearward housing sections 36 and 38 disposed proximate one edge (in the front-rear direction) of the fin housing chambers 32, so that the bumps 192 will clear the belt 52 in the front-rear direction. The internal bumps 192 are made sufficiently shallow to leave clearance for threading the belt 52 past them into operative position in the fin housing chambers 32.

Figure 9:
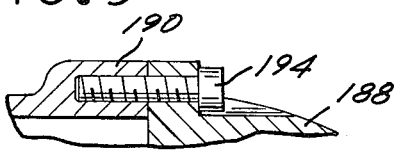
FIG. 9 is an enlarged, fragmentary horizontal section taken on the line 9—9 in FIG. 3.
Figure 5:
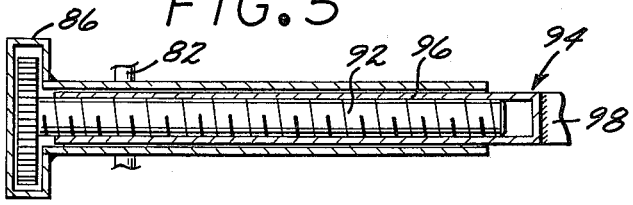
FIG. 5 is a fragmentary horizontal section taken on the line 5—5 in FIG. 2 illustrating internal details of the power trim and tilt mechanism of the invention.

This arrangement of external bumps 190 above the cavitation plate and internal bumps 192 below the cavitation plate is best illustrated in FIGS. 7, 9 and 13. The bumps or bosses 190 and 192 are tapped to receive screws 194 which are preferably of the Allen head type. As seen in FIG. 13, the screws 194 for the lower portions of the housing fins 26 extend through the solid rear body portions 188 of the rearward housing section 38 and into threaded engagement with the tapped bores in internal bumps 192, with the head of screws 194 completely recessed within the streamlined outer surfaces of the body portions 188. However, the screws 194 which connect the housing sections in the upper portions of the housing fins 26 above the cavitation plate may have their heads partially exposed as seen in FIG. 9.

GEARED EMBODIMENT

FIGS. 18 and 19 illustrate a reduction gear embodiment of the present stern drive, wherein the shaft **124*a* has a gear 196 keyed thereon just forward of the needle bearing 138*a*. Since there is no need for the shaft 124*a* to tilt, the other bearing 134*a* which supports shaft 124*a*** need not be of the self-aligning type.

A pulley-supporting shaft 198 is mounted at its rear end in a needle bearing **138*b*, and at its forward end in a self-aligning bearing 134*b*. The shaft 198 extends in the front-rear direction across the upper housing chamber 30, and has belt drive pulley or sprocket 146*a* keyed forwardly thereon and driven gear 200 keyed rearwardly thereon, the gear 200 being drivingly meshed with the gear 196 in the operative condition of the drive as illustrated in FIGS. 18 and 19**.

The geared embodiment of the invention as shown in FIGS. 18 and 19 is operated in generally the same way as the non-geared version heretofore described for installation and removal of the drive belt 52*a*, except that the shaft 198 instead of the shaft 124 is the tiltable shaft. Thus, with the forward and rearward housing sections 36 and 38, respectively, separated, the self-aligning 134*b* enables the shaft 198 to tilt downwardly, thereby providing separation between the gears 196 and 200 and enabling the drive belt 52*a* to be passed between the gears 196 and 200 for installation or removal, and engaged over or removed from the pulley 146*a* in the relaxed condition of the belt. The rearward end of shaft 198 is frusto-conically beveled in the same manner as the shaft 124 so as to be cammed upwardly and thereby pivot the shaft 198 upwardly about the self-aligning bearing 134*b*, the rearward end portion of shaft 198 then being engaged within the needle bearing 138*b* with the belt 52*a* fully tensioned. The belt 52*a* will be a somewhat shorter continuous belt than the belt 52 for the non-geared embodiment.

The gears 196 and 200 are arranged to freely slide off of the rear ends of the respective shafts 124*a* and 198 when the housing sections 36 and 38 are separated, thereby permitting quick rear ratio changes to be made. In the aforesaid prototype a gear ratio of about 1.6 to 1 has been satisfactorily employed. It is presently contemplated that gear ratios may range from about 2.15 to 1 to about 1 to 1.

It may also be desirable to have a speed ratio of other than 1 to 1 embodied in the non-geared embodiment of the invention as illustrated in FIGS. 3, 6 and 7, in which case the upper belt drive pulley or sprocket 146 will have a somewhat smaller diameter than the lower driven belt pulley or sprocket 166 as best seen in FIG. 7. This can be accomplished without requiring any increase in the thickness of the housing fins 26 by having the housing fins 26 toe in slightly from their lower ends toward their upper ends, so that the fins 26 are not exactly parallel in the vertical direction, but have a very slight included angle. This slight toe-in of the fins 26 does not materially alter the hydrodynamics of the drive. For presently available engine and propeller equipment, a satisfactory speed ratio between the pulleys 146 and 166 is about 1 ½ to 1; and with the thin, wide drive belt 52 of the character hereinabove described in detail, an example of typical pulleys will be an upper pulley 146 having about 30 grooves in the periphery thereof and a lower pulley 166 having about 44 grooves in the periphery thereof.

THE LUBRICATION MEANS

The present invention also includes novel lubrication means. With the large amount of torque that is being delivered through the drive, conventional packed bearings are generally inadequately lubricated and become too hot. Flowable oil is desired for lubrication, both because of its lubricating capability and because in flowing it is cooled against the inside of the housing. However, for maximum efficiency it is desirable to only utilize a small amount of oil, and to have it strategically directed to the bearings so that each of the bearings will at all times have a solid flow of oil therethrough. Further, to maintain a minimum frontal area of the drive, particularly in the lower portion thereof, it is desirable not to add an oil pump, but to utilize the belt as a means for transporting oil from the bottom of the housing up to the upper part of the housing. Nevertheless, a simple oil aligning system is inadequate, since the oil slung off of the upper part of the belt would simply flow down along the walls of the upper housing portion and not be captured in the bearings in any appreciable quantities.

According to the invention, a small quantity of oil is introduced into the housing through an oil plug 202 removably disposed in the top wall of upper housing portion 22. This oil should be in an amount sufficient to immerse the bottom of the belt 52 in the oil in the lower housing portion 24, and sufficient to provide good oiling for the prop shaft bearings 152 and 156.

Assuming that the pulleys will be turning clockwise viewing the drive from the rear, then oil will be transported by the belt upwardly adjacent to the left-hand or upstream side wall 204 of upper housing portion 22 and will be deposited on the right-hand or downstream sidewall 206 of upper housing portion 22. A series of inclined troughs 208, 210, 212 and 214 are disposed in the right-hand sidewall 206 in such a manner as to catch the oil as it flows off of the belt and on to the sidewall 206 and deliver the oil thus caught to the bearings. Thus, the upper inclined trough 208 inclines downwardly and forwardly into communication with a generally horizontal trough 216 recessed in the front surface 48 of the upper housing chamber 30. A passage 218 provides communication for the flow of oil from the horizontal trough 216 to the front of self-aligning bearing 134. Thus, oil captured in the inclined trough 208 will flow forwardly and downwardly into the transverse, generally horizontal trough 216, and thence through the passage 218 into the bearing 134.

The second inclined trough 210 inclines downwardly and rearwardly into communication with a transverse, generally horizontal trough 220 recessed in the rear surface 44 of upper housing chamber 30. Passage 222 conducts oil from trough 220 to the back of needle bearing 138 to provide a solid body of oil to the needle bearing 138.

Inclined trough 212 also extends downwardly and rearwardly, pouring its oil into transverse, generally horizontal trough 224 which feeds passage 226 which conducts oil to the back of bearing recess 228 adapted in the geared embodiment of the drive as seen in FIG. 18 to receive needle bearing 138*b*.

Similarly, forwardly and downwardly inclined trough 214 provides oil to transverse, generally horizontal trough 230, which in turn feeds passage 232 which provides oil to the front of a bearing recess 234 that is adapted in the geared embodiment of the invention to receive bearing 134*b*.

Even without the inclined side wall troughs, there will normally be adequate distribution of oil from the belt along the belt to provide an adequate supply of oil to the transverse troughs 216, 220, 224 and 230.

During operation of the drive, the passages 218, 222, 226 and 232 will become filled with oil so as to provide a solid body of oil to the bearings, and then any excess of oil will overflow out of the respective transverse troughs 216, 220, 224 and 230 and flow down the respective upper chamber surfaces 44 and 48, some of this overflow oil assisting in the oiling of the bearings, but most of this simply flowing back down with oil from the bearings to the bottom of the housing for recirculation.

THE CAVITATION PLATE

A cavitation plate 236 is horizontally disposed on the stern drive 10 just above the maximum diameter of the prop 162 and extending both forwardly and rearwardly of the prop 162. A cavitation plate is an important element of a modern stern drive wherein a large amount of power is delivered to the prop, to keep air from being drawn down from the surface of the water by the prop and to thereby allow the drive to be run higher in the water with correspondingly reduced drag. Preferably, the cavitation plate 236 is located approximately one inch above the maximum diameter of prop 162, and with the cavitation plate 236 the drive can be vertically positioned on the boat so that the top of the circle described by the prop may only be two inches below the bottom of the boat.

For maximum strength and minimum turbulence, the cavitation plate 236 is preferably integrally formed as a part of the housing 20. With the interface 28 located as shown in the drawings proximate the rearward edges of the intermediate housing chambers 32, it is desirable that the cavitation plate 236 be formed in two coplanar sections, a rearward section 238 that is integral with the rearward housing section 38, and a forward section 240 that is integral with the forward housing section 36. As best seen in FIGS. 3, 6 and 7, the cavitation plate 236 is generally centrally located along the vertical lengths of the intermediate housing fins 26 so as to divide the space between the fins 26 into a pair of vertically separated, longitudinally (in the front-rear direction) directed flow tunnels, a lower tunnel 242 and an upper tunnel 244. The cavitation plate 236 additionally provides greatly increased strength and rigidity to the thin fin portions of the housing by serving as a transverse structural strut between the housing fins 26 in a generally central location along the vertical lengths of the fins 26, and this structural function is accomplished without introduction of turbulence as would occur from separate structural members. By having the cavitation plate 236 formed in the separate sections 238 and 240 associated with the respective housing sections 38 and 36, each of the housing sections 38 and 36 is thereby separately structurally reinforced.

THE LOWER AND UPPER FLOW TUNNELS

The lower and upper flow tunnels 242 and 244, respectively, serve important functions in a high degree of prop efficiency, in improved steerability over conventional stern drives, and in the minimization of drag as compared with conventional stern drives. Thus, the lower flow tunnel 242 serves to capture and confine a column of water ahead of the prop so as to in effect "force feed" a solid column of substantially undisturbed water to the prop in the upper arc of its circle. As will be seen hereinafter, the relative locations in the front-rear direction of the fins 26, the lower housing hub 24, and the cavitation plate 236, as well as the configurations of the fins and the lower housing hub 24, are such that the flow of water in the column delivered to the prop through the lower tunnel 242 is generally laminar and non-turbulent so as to optimize prop efficiency. In contrast, conventional prior art shaft and bevel gear type stern drives here a substantial width of shaft housing directly in front of the prop, which inevitably causes substantial turbulence and corresponding loss of prop efficiency. Further, the positive longitudinal direction imparted to the water column by the lower tunnel provides an improved steering effect which is apparent at all boat operational speeds.

Provision of the upper flow tunnel 244 allows a solid body or column of water to flow longitudinally through the drive generally above the water line without substantial aeration or turbulation. A body of water inevitably sweeps up behind a fast moving boat, and in conventional stern drives having a unitary shaft housing this requires provision of a second, upper horizontal plate spaced above the cavitation plate, serving as a deflector to hold down the up-swept water, and this causes much of the up-swept water to be diverted laterally behind the solid drive column, creating substantial drag. Such additional drag is substantially completely avoided in the present stern drive by means of the upper flow tunnel 244, and the directed flow of this extra column of water through the upper tunnel 244 assists in steering at high boat speeds. No such second, upper plate is even required with the presence of the upper tunnel 244.

MINIMIZATION OF TURBULENCE AT THE LOWER TUNNEL

In order for the lower tunnel 242 to be most effective in delivering a solid column of water to the pump 162, it is important to minimize turbulence that may be introduced into the water before it is captured in the lower tunnel 242. In this regard, it is particularly important to minimize compressive effects on the water as it is guided into the lower tunnel 242. Because of its relatively large frontal area, the lower housing hub 24 is a major factor that must be considered in avoiding turbulence and compression drag in the lower tunnel 242. The lower housing hub 24 is accordingly provided with a rounded expander 246 at its front end which is preferably substantially completely forward of the leading edges 248 of the fins 26 as best seen in FIGS. 2, 6 and 8. In other words, the lower hub member 24 preferably has reached its maximum diameter proximate the leading edges 248 of the fins 26 so that its separation of the water will be substantially complete by the time the water reaches the enclosure between the fins, whereby the hub 24 will not cause compressive expansion of the water between the fins.

Another feature which is preferably employed to minimize compressive effects on the water between the fins is to have the leading edges 248 of the fins offset inwardly toward the tunnel from longitudinal (front-rear), vertical planes that are laterally centered in the respective fins, as best illustrated in FIGS. 8, 11 and 12. Thus, the solid front body portions 186 of the fins are contoured with a large taper 250 extending rearwardly from the leading edges 248 on the outer surfaces of the fins, and a small taper 251 extending rearwardly on the inner surfaces of the fins.

It is also important in minimizing turbulence in the lower tunnel 242 to have the leading edge 252 of the cavitation plate 236 displaced substantially rearwardly of the leading edges 248 of the fins and of the hub expander 246 so as to allow substantial recovery room from the separation of water by the expander 246 and by the front body portions 186 of the fins before the water enters the lower tunnel 242 which has its front end defined by the leading edge 252 of the cavitation plate. It is preferred to have the leading edge 252 of the cavitation plate offset at least about two to three inches rearwardly of the expander 246 and of leading edges 248 of the fins to allow sufficient recovery room for the water to settle down to a substantially laminar flow before entering the lower tunnel 242, and if desired, the leading edge 252 of the cavitation plate may be considerably further rearwardly disposed than that. The leading edge 252 of the cavitation plate is illustrated in the drawings as being located approximately centrally located along the axial (front-rear) lengths of the fins, which is a satisfactory position allowing plenty of recovery room.

Prior art belt driven stern drives have in general failed to satisfactorily compete with shaft and bevel gear driven stern drives mainly because the prior art belt driven stern drives had more drag and created greater turbulence in the water flow to the prop. In contrast, in the present invention the belt housing fins, fixed hub and cavitation plate are so configured and arranged relative to each other as to minimize drag and turbulence, and to improve prop efficiency and steerability of the drive by the flow of water through the discrete lower and upper tunnels. Thus, the present stern drive has a combination of low drag and prop efficiency characteristics that is considerably better than the various prior belt driven stern drives; and that is at least as good as, and probably better than, the best of the present shaft and bevel gear drives.

An important broadly new aspect of the construction of the present stern drive as compared with that of prior art drives of both the belt driven and shaft-bevel gear types is the very narrow transverse dimensions of the belt housing fins as compared to the front-rear widths thereof. Thus, in the aforesaid prototype the ratio of transverse thickness to front-rear width of each fin was only about 1 to 10. It is preferred that this ratio be at least about 7:1, and preferably on the order of about 10 to 1 or more, in the region of the lower tunnel 242, in view of the following factors: (1) substantial belt width for adequate power delivery, (2) high shear strength in the front-rear direction, (3) optimum hydrodynamic configuration in the front-rear direction, with the capability of passing through the water and functioning more on the order of rudder or keel fins than as obstructions, and (4) to give the water adequate time to settle down after being separated by the expander and confined between the fins before being captured in the lower housing tunnel that commences at the cavitation plate.

THE CAVITATION PLATE SUPPORT RIB

Because of the heavy vertical loading on cavitation plate 236, the plate 236 is preferably supported by means of a vertical support rib transversely centrally located in the upper tunnel 244 and having its plane parallel to the planes of the fins 26. The support rib 254 extends from the cavitation plate 236 upwardly into engagement with the upper housing portion 22, and is preferably an integral part of the rearward housing section 38. Since most of the vertical loading is on the rearward section 238 of the cavitation plate, the rib 254 need not be engaged with the forward section 240 of the cavitation plate.

A sacrificial trim tab 256 is pivotally adjustably connected to the rearward section 238 of the cavitation plate, and is preferably made of zinc and is adapted to minimize electrolysis of the aluminum housing.

A prop guard keel 258 depends from the hub 24 so as to deflect any underwater obstructions from the prop.

While the instant invention has been shown and described herein in what are conceived to be the most practical and preferred embodiments, it is recognized that departures may be made therefore within the scope of the invention, which is therefore not to be limited to the details disclosed herein, but is to be accorded the full scope of the appended claims.

I claim:

1. A stern drive which comprises a generally upright housing having an upper portion adapted to be mounted on the stern of a boat, a lower hub portion, and a pair of generally parallel, vertically elongated, longitudinally wide, laterally thin intermediate fin portions extending between said upper and lower portions, said housing portions all defining therein communicating cavities; a drive pulley rotatably supported in said upper housing portion and having rotary power input means drivingly connected thereto; a driven pulley rotatably supported in said lower hub portion and drivingly connected to a prop shaft mounted in said hub portion and projecting rearwardly therefrom; a laterally thin, longitudinally wide drive belt operatively engaged over said pulleys and extending through said fin cavities for transmitting power between said pulleys; said housing being split into forward and rearward housing sections at a generally transverse, vertical interface that communicates with all of said housing cavities, said housing sections being separable to provide access to said cavities for installation or removal of said drive belt; and a generally horizontal cavitation plate supported on said housing, said cavitation plate extending between said intermediate housing fins at a position intermediate the vertical lengths of said fins and projecting rearwardly beyond the fins so as to overlie a prop mounted on said prop shaft.

2. A stern drive as defined in claim 1, which includes cavitation plate support rib means extending downwardly from said upper housing portion of said rearward housing section into engagement with said cavitation plate.

3. A stern drive which comprises a generally upright housing having an upper portion adapted to be mounted on the stern of a boat, a lower hub portion, and a pair of generally parallel, vertically elongated, longitudinally wide, laterally thin intermediate fin portions extending between said upper and lower portions, said housing portions all defining therein communicating cavities; a drive pulley rotatably supported in said upper housing portion and having rotary power input means drivingly connected thereto; a driven pulley rotatably supported in said lower hub portion and drivingly connected to a prop shaft mounted in said hub portion and projecting rearwardly therefrom; a laterally thin, longitudinally wide drive belt operatively engaged over said pulleys and extending through said fin cavities for transmitting power between said pulleys; said housing being split into forward and rearward housing sections at a generally transverse, vertical interface that communicates with all of said housing cavities, said housing sections being separable to provide access to said cavities for installation or removal of said drive belt; and a generally horizontal cavitation plate supported on said housing, said cavitation plate extending between said intermediate housing fins and projecting rearwardly beyond the fins so as to overlie a prop mounted on said prop shaft, at least a portion of said cavitation plate being connected to both fin housing portions of at least one of said housing sections intermediate their vertical lengths so as to provide a structural strut between the fins.

4. A stern drive as defined in claim 3, wherein said cavitation plate includes generally coplanar forward and rearward sections, said forward section of the cavitation plate being connected to both fin housing portions of said forward housing section, and said rearward section of the cavitation plate being connected to both fin housing portions of said rearward housing section.

5. A stern drive which comprises a generally upright housing having an upper portion adapted to be mounted on the stern of a boat, a lower hub portion, and a pair of generally parallel, vertically elongated, longitudinally wide, laterally thin intermediate fin portions extending between said upper and lower portions, said housing portions all defining therein communicating cavities; a drive pulley rotatably supported in said upper housing portion and having rotary power input means drivingly connected thereto; a driven pulley rotatably supported in said lower hub portion and drivingly connected to a prop shaft mounted in said hub portion and projecting rearwardly therefrom; a laterally thin, longitudinally wide drive belt operatively engaged over said pulleys and extending through said fin cavities for transmitting power between said pulleys; said housing being split into forward and rearward housing sections at a generally transverse, vertical interface that communicates with all of said housing cavities, said housing sections being separable to provide access to said cavities for installation or removal of said drive belt; said drive pulley being mounted on and keyed to a driven shaft that is rotatably supported in said upper housing portion and said driven pulley being mounted on and keyed to said prop shaft in said lower housing hub portion, each of said pulley shafts being rotatably supported forwardly of its respective pulley in said forward housing section and rearwardly of its respective pulley in said rearward housing section, said shafts having end portions that are disengageable from one of said housing sections upon separation of the housing sections so as to expose corresponding ends of the two pulleys for installation or removal of said drive belt; and drive belt tensioning means comprising vertically shiftable engagement means between one of said shafts and at least said one housing section, and cam means operable upon movement of said housing sections together to shift said one shaft vertically from a belt release position when the housing sections are separated to a belt tensioning position when the housing sections are together.

6. A stern drive which comprises a generally upright housing having an upper portion adapted to be mounted on the sterm of a boat, a lower hub portion, and a pair of generally parallel, vertically elongated, longitudinally wide, laterally thin intermediate fin portions extending between said upper and lower portions, said housing portions all defining therein communicating cavities; a drive pulley rotatably supported in said upper housing portion and having rotary power input means drivingly connected thereto; a driven pulley rotatably supported in said lower hub portion and drivingly connected to a prop shaft mounted in said hub portion and projecting rearwardly therefrom; a laterally thin, longitudinally wide drive belt operatively engaged over said pulleys and extending through said fin cavities for transmitting power between said pulleys; said housing being split into forward and rearward housing sections at a generally transverse, vertical interface that communicates with all of said housing cavities, said housing sections being separable to provide access to said cavities for installation or removal of said drive belt; said drive pulley being mounted on and keyed to a driven shaft that is rotatably supported in said upper housing portion and said driven pulley being mounted on and keyed to said prop shaft in said lower housing hub portion, each of said pulley shafts being rotatably supported forwardly of its respective pulley in said forward housing section and rearwardly of its respective pulley in said rearward housing section, said shafts having end portions that are disengageable from one of said housing sections upon separation of the housing sections so as to expose corresponding ends of the two pulleys for installation of removal of said drive belt; and drive belt tensioning means comprising tiltable rotational support means for one of said shafts in the other said housing section permitting the disengageable end portion of said one shaft to tilt in a belt release position toward the other said shaft, and cam means engageable between said one housing section and said tiltable shaft as the housing sections are brought together so as to cam said tiltable shaft into a belt tensioning position generally parallel to the other shaft.

7. A stern drive as defined in claim 6, wherein said tiltable rotational support means comprises a self-aligning bearing.

8. A stern drive as defined in claim 6, wherein said cam means comprises a taper on said disengageable end portion of said one shaft.

9. A stern drive as defined in claim 6, wherein said tiltable shaft is said drive pulley shaft in said upper housing portion.

10. A stern drive as defined in claim 9, wherein said tiltable shaft is a stern drive input shaft forming a part of said rotary power input means, said input shaft having a forward portion extending forwardly of said upper housing portion.

11. A stern drive as defined in claim 9, wherein said rotary power input means includes a stern drive input shaft rotatably supported in said upper housing portion spaced above said tiltable shaft, and a gear drive connection between said input shaft and said tiltable shaft, said gear connection being separable upon tilting of said tiltable shaft for installation or removal of said drive belt.

12. A stern drive which comprises a generally upright housing having an upper portion adapted to be mounted on the sterm of a boat, a lower hub portion, and a pair of generally parallel, vertically elongated, longitudinally wide, laterally thin intermediate fin portions extending between said upper and lower portions, said housing portions all defining therein communicating cavities, a drive pulley rotatably supported in said upper housing portion and having rotary power input means drivingly connected thereto, a driven pulley rotatably supported in said lower hub portion and drivingly connected to a prop shaft mounted in said hub portion and projecting rearwardly therefrom, and a laterally thin, longitudinally wide drive belt operatively engaged over said pulleys and extending through said fin cavities for transmitting power between said pulleys, said housing being split into forward and rearward housing sections at a generally transverse, vertical interface that communicates with all of said housing cavities, said housing sections being separable to provide access to said cavities for installation or removal of said drive belt, said housing sections being secured together by means of a plurality of generally longitudinally directed fasteners, at least one of said housing sections in the region of said fin housing portion presenting thin edges of a pair of closely transversely spaced, thin side walls of each fin at said interface, and a plurality of vertically spaced thickening bumps in each of said side walls for each fin for receiving said fasteners.

13. A stern drive as defined in claim 12, wherein said thickening bumps, in the region of each fin vertically registering with the arc of a prop mounted on said prop shaft, are internal bumps extending into the fin cavity in vertically staggered relationship from the closely spaced side walls of the fin, each bump being spaced from the opposite side wall at least an amount corresponding to the thickness of the drive belt to permit installation or removal of the belt.

14. A stern drive as defined in claim 13, wherein said internal bumps are spaced in the front-rear direction from the edges of the drive belt, in the installed position of the belt.

15. A stern drive which comprises a generally upright housing having an upper portion adapted to be mounted on the stern of a boat, a lower hub portion, and a pair of generally parallel, vertically elongated, longitudinally wide, laterally thin intermediate fin portions extending between said upper and lower portions, said housing portions all defining therein communicating cavities; a drive pulley rotatably supported in said upper housing portion and having rotary power input means drivingly connected thereto; a driven pulley rotatably supported in said lower hub portion and drivingly connected to a prop shaft mounted in said hub portion and projecting rearwardly therefrom; a laterally thin, longitudinally wide drive belt operatively engaged over said pulleys and extending through said fin cavities between said pulleys; said intermediate housing fins defining therebetween a vertically elongated passage means extending through the drive in the longitudinal direction, said passage means extending vertically between the fins from a lower limit defined by an upper surface portion of said prop hub to an upper limit defined by a lower surface portion of said upper housing portion, said upper limit being located substantially above the bottom of the boat in the mounted, operative position of the drive on the stern of a boat, said passage means during operation of the drive feeding a generally uninterrupted body of water to the prop through the lower part of the passage means and providing relief for water sweeping up behind the boat through the upper part of the passage means; and a generally horizontal cavitation plate extending between said fins intermediate the vertical length of said passage means, said cavitation plate having a forward portion between the fins which divides said passage means into lower and upper longitudinally directed flow tunnels, and said cavitation plate having a rearward portion projecting rearwardly beyond the fins to overlie a prop mounted on said prop shaft, said lower flow tunnel feeding a generally uninterrupted body of water to the prop, and said upper tunnel providing relief for water sweeping up behind the boat.

16. A stern drive as defined in claim 15, wherein the leading edge of said forward portion of the cavitation plate is offset rearwardly from the adjacent leading edges of said fins.

17. A stern drive as defined in claim 16, wherein the forward portions of the fins are contoured so that the leading edges of the fins are laterally offset inwardly toward said passage means from planes extending vertically, longitudinally through the lateral centers of the fins.

18. A stern drive as defined in claim 15, wherein said hub portion of the housing includes a forward expander portion projecting substantially completely forward of the leading edge of said forward portion of the cavitation plate.

19. A stern drive as defined in claim 18, wherein said expander portion of the hub projects substantially completely forward of the leading edges of the fins and of said forward portion of the cavitation plate.

20. A stern drive as defined in claim 19, wherein the leading edge of said forward portion of the cavitation plate is offset rearwardly from the adjacent leading edges of the fins.

21. A stern drive which comprises a generally upright housing having an upper portion adapted to be mounted on the stern of a boat, a lower rub portion, and a pair of generally parallel, vertically elongated, longitudinally wide, laterally thin intermediate fin portions extending between said upper and lower portions, said housing portions all defining therein communicating cavities; a drive pulley rotatably supported in said upper housing portion and having rotary power input means drivingly connected thereto; a driven pulley rotatably supported in said lower hub portion and drivingly connected to a prop shaft mounted in said hub portion and projecting rearwardly therefrom; a laterally thin, longitudinally wide drive belt operatively engaged over said pulleys and extending through said fin cavities between said pulleys; said intermediate housing fins defining therebetween a vertically elongated passage means extending through the drive in the longitudinal direction, said passage means extending vertically between the fins from a lower limit defined by an upper surface portion of said prop hub to an upper limit defined by a lower surface portion of said upper housing portion, said upper limit being located substantially above the bottom of the boat in the mounted, operative position of the drive on the stern of a boat, said passage means during operation of the drive feeding a generally uninterrupted body of water to the prop through the lower part of the passage means and providing relief for water sweeping up behind the boat through the upper part of the passage means; said drive pulley being mounted on a shaft that is journaled in bearings mounted in the front and rear walls of said upper housing portion; and means for delivering oil to at least one of said bearings which comprises transversely arranged trough means in the wall in which said one bearing is mounted and located above said one bearing, said passage means in such wall extending from said transverse trough means to the back of the bearing, oil lifted by the belt from a supply thereof in said lower housing portion being deposited in the wall means in the upper housing portion and flowing downwardly into said trough means and thence through said passage means to the bearing.

* * * * *